United States Patent [19]

Hoehn, Jr.

[11] Patent Number: 4,542,600

[45] Date of Patent: Sep. 24, 1985

[54] METHOD FOR CONTROLLING THE DEPTH OF DRAGLINE EXCAVATING OPERATIONS

[75] Inventor: Gustave L. Hoehn, Jr., Dallas, Tex.

[73] Assignee: Mobil Oil Corporation, New York, N.Y.

[21] Appl. No.: 668,919

[22] Filed: Nov. 6, 1984

[51] Int. Cl.[4] ..... E02F 3/46

[52] U.S. Cl. ..... 37/195; 37/116; 37/DIG. 1; 414/699; 364/433; 364/579

[58] Field of Search ..... 37/115–116, 37/195, DIG. 1; 414/699; 364/433, 579

[56] References Cited

U.S. PATENT DOCUMENTS

| | | | |
|---|---|---|---|
| 3,460,278 | 8/1969 | Pesavento et al. | 37/116 |
| 3,636,325 | 1/1972 | Chytil | 37/116 |
| 3,934,126 | 1/1976 | Zalesov et al. | 37/DIG. 1 |
| 4,038,765 | 8/1977 | Sankey et al. | 37/116 |
| 4,332,517 | 6/1982 | Igarashi et al. | 37/DIG. 1 |
| 4,368,521 | 1/1983 | Sholes, II | 37/DIG. 1 |
| 4,370,713 | 1/1983 | McCoy, Jr. | 37/116 |

FOREIGN PATENT DOCUMENTS

| | | | |
|---|---|---|---|
| 48309 | 9/1983 | Japan | 37/DIG. 1 |
| 374422 | 6/1973 | U.S.S.R. | 37/DIG. 1 |
| 594252 | 2/1978 | U.S.S.R. | 37/116 |
| 602650 | 4/1978 | U.S.S.R. | 37/115 |
| 627219 | 10/1978 | U.S.S.R. | 37/DIG. 1 |
| 657130 | 4/1979 | U.S.S.R. | 37/116 |
| 682615 | 8/1979 | U.S.S.R. | 37/DIG. 1 |
| 629950 | 10/1979 | U.S.S.R. | 37/DIG. 1 |
| 703630 | 12/1979 | U.S.S.R. | 37/DIG. 1 |
| 713968 | 2/1980 | U.S.S.R. | 37/116 |
| 742542 | 6/1980 | U.S.S.R. | 37/116 |
| 787562 | 12/1980 | U.S.S.R. | 37/DIG. 1 |

*Primary Examiner*—E. H. Eickholt

*Attorney, Agent, or Firm*—A. J. McKillop; Michael G. Gilman; George W. Hager, Jr.

[57] ABSTRACT

The operation of a dragline machine in digging below the earth's surface is monitored to provide measurements of the variations in pull cable length, lift cable length, and main boom inclination. From these measurements, the angle of inclination of the pull cable below the horizontal is determined. The depth of the excavation is then determined from the length of the pull cable and its inclination.

2 Claims, 3 Drawing Figures

METHOD FOR CONTROLLING THE DEPTH OF DRAGLINE EXCAVATING OPERATIONS

BACKGROUND OF THE INVENTION

Large-scale excavation of the earth's surface may be carried out with what is commonly called a "dragline" machine. This machine basically employs a large boom, in the order of 240 feet, to lower an excavation bucket by means of a lift cable to a desired point on the earth where excavating is to be done. This bucket has teeth which dig into the earth for removing dirt as the bucket is reeled in or dragged by means of a pull cable extending along the earth's surface to the bucket. Such a dragline, as one manufactured by Page Engineering, weighs up to four million pounds and can dig at a rate of up to 2,640 cubic yards an hour. Run by a two-person crew, an operator and an oiler, the dragline machine uses electric current supplied by a cable from a power substation. Other dragline manufacturers are Bucyrus-Erie Company, Milwaukee, Wis.; American Hoist & Derrick Co., St. Paul, Minn.; and Manitowoc Engineering Co., Manitowoc, Wis.

SUMMARY OF THE INVENTION

In accordance with the present invention, there is provided a method for determining the depth of excavation into the earth's surface carried out by a dragline machine having a pull cable extending from a pivot point on the machine along and below the earth's surface to an excavating bucket below the earth's surface, a main boom extending from the pivot point to a position above the earth's surface, and a lift cable extending downward from the end of the main boom to the excavating bucket below the earth's surface. The length of the lift cable extending downward from the main boom to the excavating bucket is measured as is the length of the pull cable from the pivot point on the excavating machine to the excavating bucket. The inclination of the main boom above the horizontal is also measured.

From these measurements the angle between the main boom and the lift cable as it extends downward from the main boom to the excavating bucket is determined. Next, the inclination of the pull cable below the horizontal is determined from the measurements of the lift cable length, pull cable length and main boom inclination and the determination of the angle between the main boom and the lift cable. Finally, the depth of the excavating bucket below the earth's surface is determined from the measurement of pull cable length and the determination of the inclination of the pull cable below the horizontal.

DESCRIPTION OF THE PREFERRED EMBODIMENT

Figure 1:
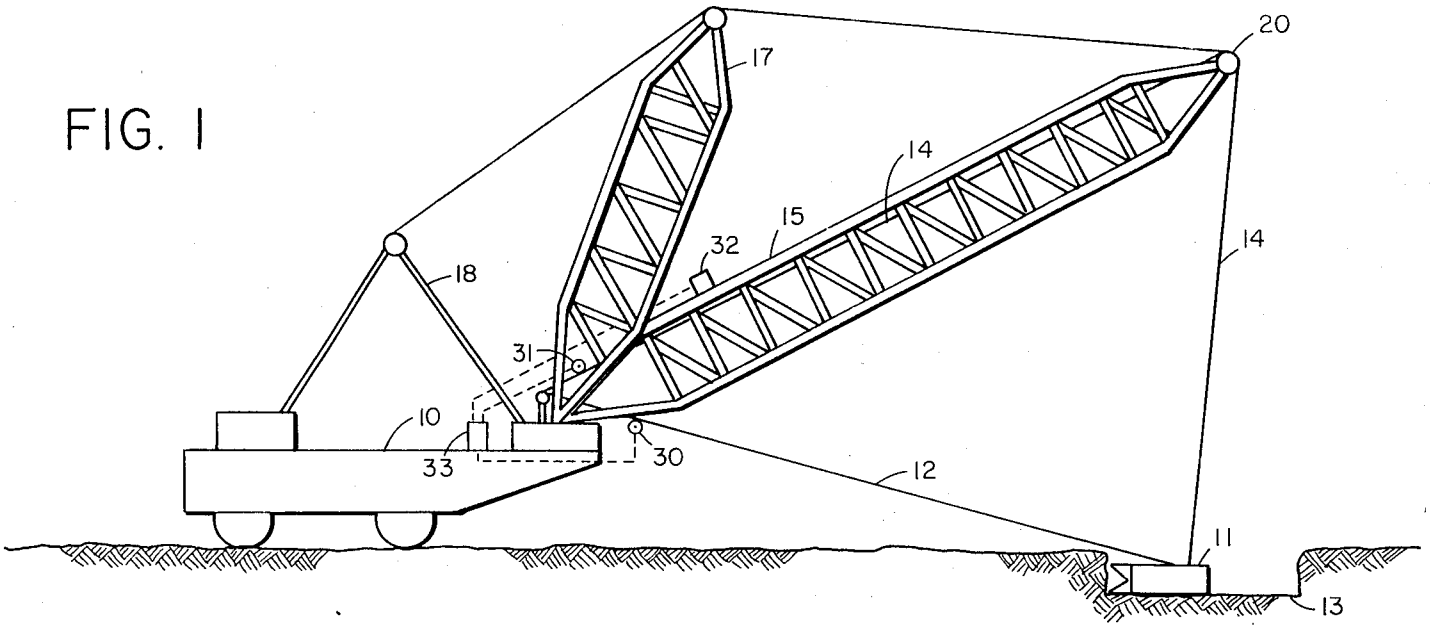
FIG. 1 illustrates a conventional dragline machine with which the method of the present invention is used.

Referring to FIG. 1, there is shown a conventional dragline machine 10 having an excavating bucket 11 attached to the end of the pull cable 12. As pull cable 12 is reeled in toward the dragline machine 10, the bucket 11 digs into the earth's surface to form the trench 13. The bucket 11 is raised and lowered by a lift cable 14 extending downward from the main boom 15. Auxiliary boom 17 and framework 18 provide additional structural support required for the operation of the dragline machine 10.

Typically, the main boom is on the order of 240 feet in length and the bucket is digging out about 200 feet or so from the operator of the dragline machine 10. Moving the boom 15 up or down by changing its inclination by only a few degrees can make a big difference in the depth of digging. Usually, the operator can see the digging operation being carried out from his vantage point on the dragline machine 10. However, there are situations when the digging may not be observable by the operator, such as, in marshy areas, or where ground water or slurry breaks through to fill the excavation trench. In these instances, the depth of the excavation bucket is not observable by the operator as it is being dragged along the excavation trench by the pull cable 12, and consequently, control of excavation depth by changing the inclination of main boom 15 is greatly hindered.

Figure 2:
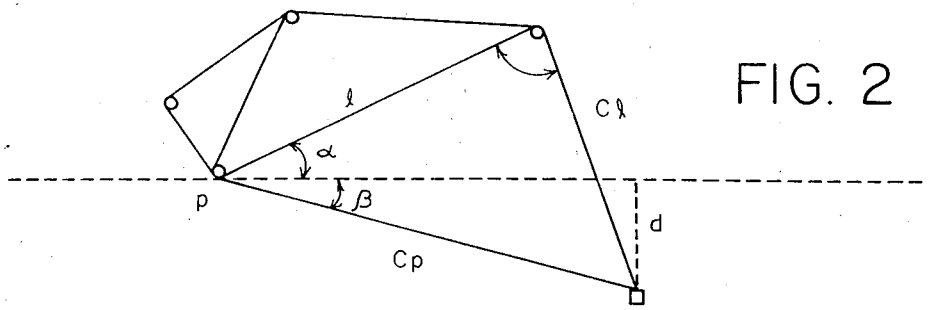
FIG. 2 is a vector schematic of the measurements made during the operation of the dragline machine of FIG. 1 and used in accordance with the present invention to the depth of the desired excavation below the earth's surface.

Accordingly, the present invention provides a method by which the operator can monitor the depth of excavation under all operating conditions. Initially, the operator lowers the bucket 11 to the desired point of excavation and digging is started. During such digging, several of the components of the operation are variable and others are fixed. FIG. 2 illustrates these components in vector schematic form. $C_P$ represents the length of the pull cable 12, $C_L$ the length of the lift cable 14 from the end of boom 15 to the bucket 11 and L the length of the boom 15. The depth of bucket 11 is indicated as D. The angle $\alpha$ represents the inclination of the boom 15 above the horizontal, angle $\beta$ represents the inclination of the pull cable 12 below the horizontal, while angle $\gamma$ represents the angle between boom 15 and lift cable 14. Each of these components is variable during excavation operations with the exception of the length L of the boom 15.

The method of the present invention is carried out to identify the variable depth D during excavation operations. The length $C_P$ of pull cable 12 may be measured by a sheave 30 mounted in rotary contact with the pull cable as the pull cable is reeled in or out by the operator. The length $C_L$ of lift cable 14 may be measured by a sheave 31 mounted in rotary contact with the lift cable as it is reeled in or out over the end of the boom 15 by the operator. The inclination of the boom 15 with the horizontal is measured by a pendulum-type sensor 32 on the boom 15. This may be a standard Humphrey CP-17 Model, Humphrey Inc., San Diego, Calif., providing an analog voltage output or a digitally encoded Giannini disc. These three components $C_P$, $C_L$ and $\alpha$ may be provided (as shown by dashed lines in FIG. 1) to a suitable programmed microprocessor 33 for solving the following set of equations utilized in the determination of the depth D. Such a microprocessor may be the Rockwell 6502, the Hewlett-Packard 85, or the Model H25D-SS-200-PIZ-74-4-EM14-S, of Baldwin Electronics Inc., Golita, Calif.

Firstly, the angle $\gamma$ between the main boom and the lift cable as it extends downwardly from the main boom to the excavating bucket is determined by the law of cosines, as follows:

$$\gamma=\cos^{-1}[(L^2+C_L^2-C_P^2)/2LC_L] \quad (1)$$

Secondly, the inclination $\beta$ of the pull cable below the horizontal is determined by the law of sines, as follows:

$$\beta=\sin^{-1}(C_L \sin \gamma/C_P)-\alpha \quad (2)$$

Finally, the depth D of the excavation bucket below the earth's surface is determined as follows:

$$D=C_P \sin \beta \quad (3)$$

Figure 3:
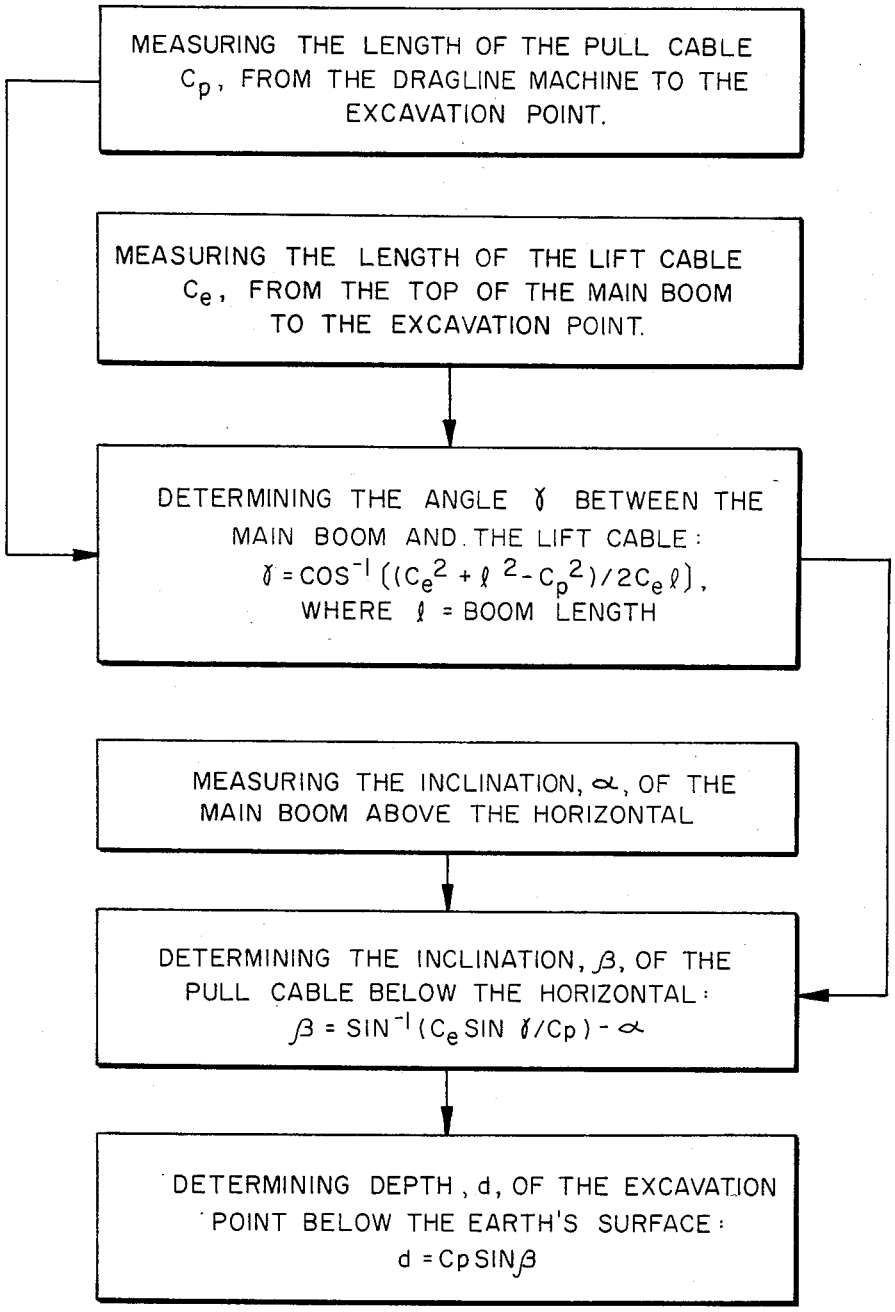
FIG. 3 is a flow chart depicting the determination of excavation depth from the measurements illustrated in FIG. 2.

This depth determination may be continually output to the operator for his use in more accurately controlling the depth of excavation, even when the excavation bucket is not visible to the operator. A flow chart of these series of steps utilized in carrying out the present invention is shown as FIG. 3.

Having now described the method of the present invention in connection with a preferred embodiment, it is to be understood that various modifications and changes may be made without departing from the spirit and scope of the invention as set forth in the appended claims.

I claim:

1. A method for controlling the depth of an excavation operation being carried out by a dragline machine having a pull cable extending along the earth's surface to the excavation bucket below the earth's surface, a main boom extending to a position above the earth's surface and a lift cable extending downwardly from the end of said main boom to said excavating bucket below the earth's surface, comprising the steps of:

(a) conducting said excavation operation in an area where a fluid such as water, slurry, or the like fills the excavation channel being dug to such an extent that the excavation bucket is beneath the fluid level and is not visible to the dragline operator as it is being dragged along the bottom of the excavation channel;

(b) measuring the length of said lift cable from said main boom to said non-visible excavating bucket;

(c) measuring the length of said pull cable to said non-visible excavating bucket;

(d) measuring the inclination of said main boom above the horizontal;

(e) determining the angle between said main boom and said lift cable as it extends from said main boom to said non-visible excavating bucket from said measurements of lift cable length, pull cable length and main boom length;

(f) determining the inclination of said pull cable below the horizontal from said measurements of lift cable length, pull cable length and main boom inclination and said determination of the angle between said main boom and said lift cable as it extends from said main boom to said non-visible excavating bucket;

(g) determining the depth of said non-visible excavating bucket below the earth's surface from said measurement of pull cable length and said determination of the inclination of said pull cable below the horizontal, and (h) adjusting the inclination of said main boom in response to said depth determination to cause the excavating operation to continue at a desired depth below the earth's surface.

2. A method for controlling the depth of excavation into the earth's surface carried out by a dragline machine havng a main boom, a lift cable, a pull cable, and an excavating bucket, comprising the steps of:

(a) measuring the length $C_L$ of said lift cable from said main boom to said excavating bucket as said excavating bucket is pulled along the bottom of an excavation channel by said pull cable, (b) measuring the length $C_P$ of said pull cable to said excavating bucket, (c) determining the angle $\gamma$ between said main boom and said lift cable as it extends from said main boom to said excavating bucket in accordance with the following:

$$\gamma=\cos^{-1}[(L^2+C_L^2-C_P^2)/2LC_L]$$

where L=length of main boom, (d) measuring the inclination $\alpha$ of said main boom above the horizontal, (e) determining the inclination $\beta$ of said pull cable below the horizontal in accordance with the following:

$$\beta=\sin^{-1}(C_L \sin \gamma/C_P)-\alpha,$$

(f) determining the depth D of said excavation bucket below the earth's surface in accordance with the following:

$$D=C_P \sin \beta,$$

(g) displaying said depth determination, and (h) controlling the depth of said excavating bucket below the earth's surface in response to said depth display.

* * * * *